US006220441B1

(12) United States Patent
Cook

(10) Patent No.: US 6,220,441 B1
(45) Date of Patent: Apr. 24, 2001

(54) METHOD AND APPARATUS FOR PRESERVING SPORTS RELATED ITEMS FOR ORNAMENTAL DISPLAY

(76) Inventor: Dominick R. Cook, 1573 Elder Ct., Manteca, CA (US) 95337

( * ) Notice: Subject to any disclaimer, the term of this patent is extended or adjusted under 35 U.S.C. 154(b) by 0 days.

(21) Appl. No.: 09/354,534

(22) Filed: Jul. 15, 1999

Related U.S. Application Data

(60) Provisional application No. 60/093,114, filed on Jul. 16, 1998.

(51) Int. Cl.[7] ..... B65D 85/00

(52) U.S. Cl. ..... 206/579; 53/432; 206/315.1; 206/315.9; 422/33; 428/17

(58) Field of Search ..... 206/315.1, 315.9, 206/579, 459.5, 423; 428/13, 17, 22, 23, 27; 53/432; 422/33

(56) References Cited

U.S. PATENT DOCUMENTS 308,950 * 12/1884 Chalvin ..... 428/13
2,551,354 * 5/1951 Wasilevich ..... 206/315.9
3,473,247 * 10/1969 Favor et al. ..... 428/11
4,217,982 * 8/1980 Clamage ..... 206/423
5,082,110 * 1/1992 Hager ..... 206/315.9
5,270,101 * 12/1993 Helicher ..... 206/232
5,377,829 * 1/1995 Bahl ..... 206/315.9
5,478,613 * 12/1995 Sugino ..... 428/13
5,791,075 * 8/1998 Martell ..... 206/315.9

* cited by examiner

*Primary Examiner*—Jim Foster
(74) *Attorney, Agent, or Firm*—John P. O'Banion

(57) ABSTRACT

An apparatus and method for preserving the color, texture and visual effect of sports related items enclosed within transparent material for purposes of ornamental display. In the preferred embodiment, the sports related item is preserved by vacuum sealing or freeze-drying and encased in transparent resin. The preserved sports item may be displayed alone or in combination with photographs, descriptions, other memorabilia and the like.

56 Claims, 9 Drawing Sheets

METHOD AND APPARATUS FOR PRESERVING SPORTS RELATED ITEMS FOR ORNAMENTAL DISPLAY

CROSS-REFERENCE TO RELATED APPLICATIONS

This application claims priority from co-pending provisional application Ser. No. 60/093,114 filed on Jul. 16, 1998.

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

1. Field of the Invention

This invention pertains generally to ornamental items, and more particularly to a method of preserving the color, texture and visual effect of sports related items for ornamental purposes.

2. Description of the Background Art It has been a popular hobby for many people over the years to collect and preserve sports memorabilia. Such items memorialize outstanding individual and team performances as well as the historical success of teams and the careers of various athletes. For example, hobbyists will collect baseballs, footballs, helmets, caps, hockey sticks, uniform jerseys, trading cards and other equipment and clothing which have been worn or used by famous athletes.

Many sporting venues have a rich history associated with them as a result of the major sporting events that have taken place there. Locations such as Pebble Beach golf course, Daytona Motor Speed Way, and Fenway Park are important places in sports history. Enthusiasts often wish to collect small pieces of the venue as memorabilia.

It is desirable for collections of memorabilia of particular value to be protected from dust and destruction and be clearly viewed at the same time. Display cases of various types are known in the art typically including a back panel and one or more horizontal shelves for holding objects. However, none of the displays have a method for preserving and presenting sports memorabilia as taught by the present invention.

BRIEF SUMMARY OF THE INVENTION

The present invention generally comprises a method for preserving sports related items enclosed within transparent material for ornamental display. The color, texture and visual effect of the sports related item is preserved by any, all or a combination of the following processes: freeze-drying, vacuum sealing, micro-vacuum process or any other known preservation process. The item is subsequently enclosed in a transparent material suitable for viewing. When the item is a section of grass, the preferred method of preservation is freeze-drying prior to encapsulation.

An object of the invention is to preserve the color of sports related items enclosed behind a transparent material for ornamental purposes.

Another object of the invention is to preserve the texture of sports related items enclosed behind a transparent material for ornamental purposes.

Still another object of the invention is to preserve the visual effect of sports related items enclosed behind a transparent material for ornamental purposes.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DETAILED DESCRIPTION OF THE INVENTION

Figure 1:
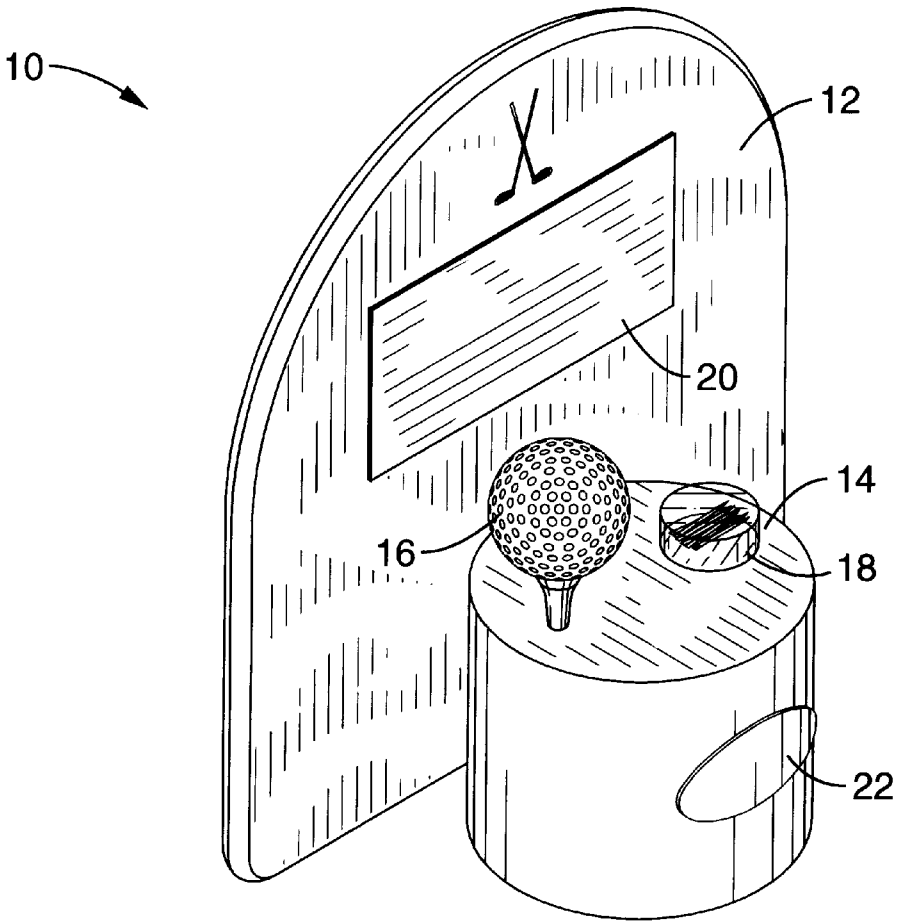
FIG. 1 is a perspective view of a plaque embodying the preservation method of the present invention.

Referring more specifically to the drawings, for illustrative purposes the present invention is embodied in the apparatus generally shown in FIG. 1 through FIG. 14, wherein like reference numerals denote like parts. It will be appreciated that the apparatus may vary as to configuration and as to details of the parts without departing from the basic concepts as disclosed herein.

This invention generally comprises an apparatus and method for preserving the color, texture and visual effect of sports related items enclosed within transparent material for ornamental display purposes. The sports related item is subjected to a preservation process that includes, but is not limited to, freeze-drying, vacuum sealing, micro-vacuum or any other known type of preservation process that would allow the visual effect and preservation of the color and texture of the item. These various processes, either alone or in combination, help preserve and protect the visual appearance and texture of the sports related item from damage from the covering process. After the sports related item undergoes the preservation process, the item is enclosed or covered in any clear material, including but not limited to, glass, resin, acrylic, etc.

The sports related items may comprise, but is not limited to, aeration plugs (grass), sand, flowers, water, trees, shrubs, bridges, roads, paths and buildings obtained directly from the actual sports facility or course. The sports related items may also comprise any personal or real property for which an exclusive license can be issued. For example, if the sport is golf, the items may comprise golf greens, water, sand, flowers, tee's, paths and all such related items. If the sport is football or baseball, the items may comprise field playing surfaces, seats, stadiums and all such related items. If the sport is basketball, the items may comprise floor playing surfaces, seats, stadiums and all such related items. For auto racing, the items may comprise the race track surface, tires and all such related items. For tennis, the items may comprise the playing surfaces and all such related items.

In FIG. 1, a limited edition plaque apparatus 10 is generally shown. Limited edition plaque apparatus 10 includes a plaque 12, shelf 14, a logo sports ball 16 disposed atop shelf 14, a sports related item 18, a photo 20 and an authenticity pledge 22. Logo sports ball 16 is typically a golf ball, baseball, miniature basketball or miniature football. Sports related item 18 is typically covered by a transparent substance, such as glass, resin, acrylic or the like, for ornamental display. Prior to being covered by the transparent substance, sports related item 18 has undergone the preservation process to help preserve and protect its visual appearance and texture.

Figure 2:
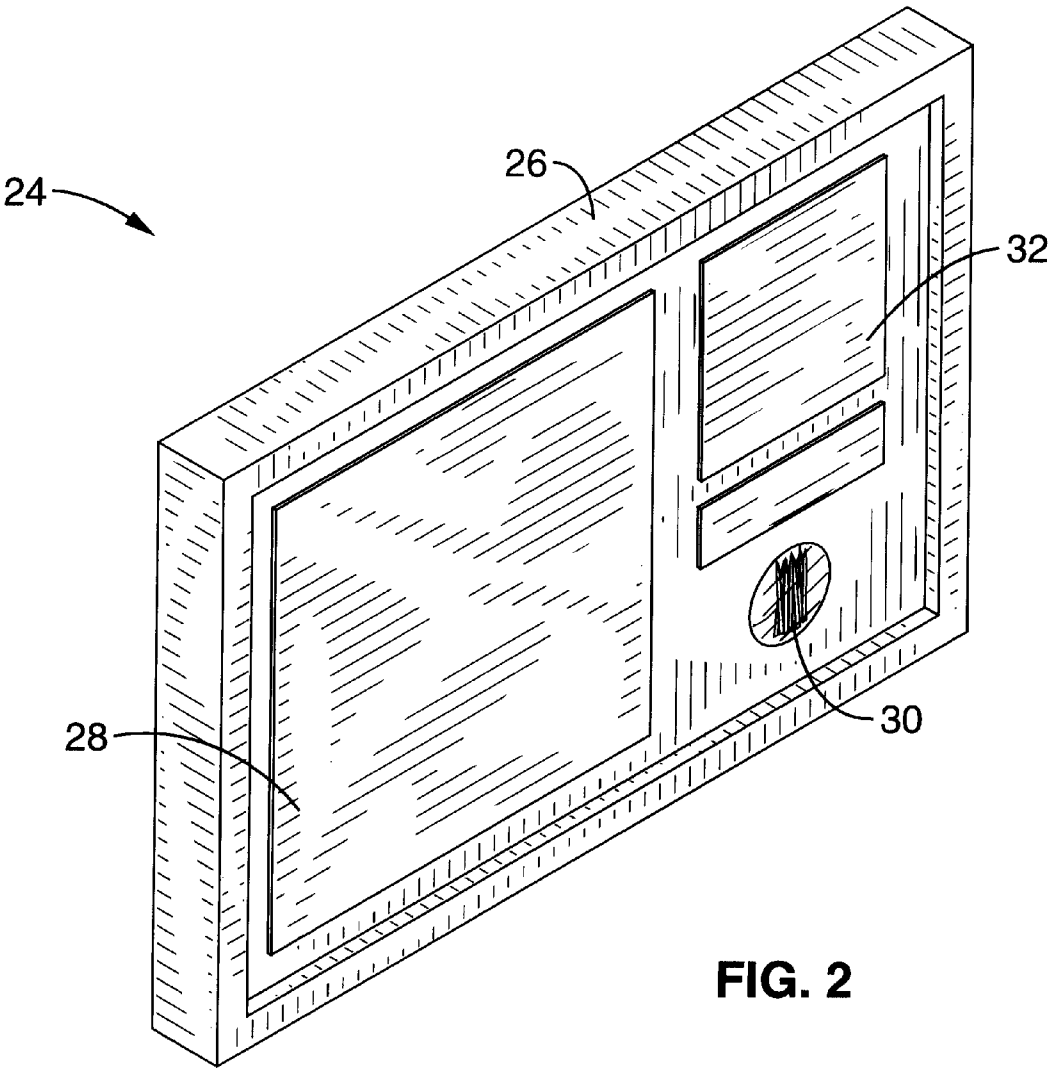
FIG. 2 is a perspective view of a frame adapted to display a sports related item embodying the preservation method of the present invention.

In FIG. 2, a limited edition print apparatus 24 is generally shown. Limited edition print apparatus 24 includes a frame 26, a photo or print 28, a sports related item 30 and a certificate of authenticity of specifically licensed sports facilities 32. Sports related item 30 has undergone the preservation process to help preserve and protect its visual appearance and texture and is covered by a transparent substance for ornamental display.

Figure 3:
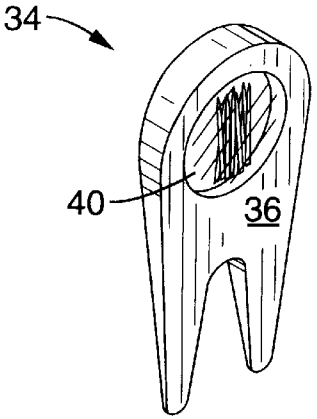
FIG. 3 is a frontal perspective view of a ball mark fixer adapted to display a sports related item embodying the preservation method of the present invention.
Figure 4:
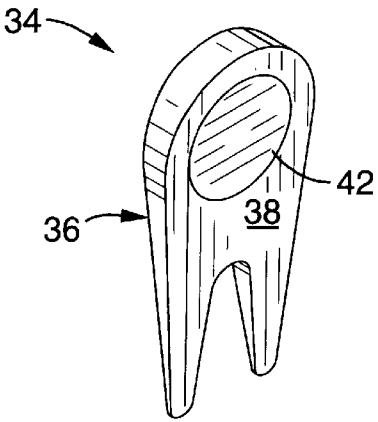
FIG. 4 is a three-quarter rear perspective view of the ball mark fixer shown in FIG. 3.

In FIG. 3 and FIG. 4, a ball mark repair apparatus 34 is generally shown. Ball mark repair apparatus 34 includes a front side 36 and a rear side 38. A sports related item 40 is displayed on front side 36 and a removable ball marker 42 with logo is removably attached to rear side 38. Typically, removable ball marker 42 with logo is magnetized, and thus can be removably attached to ball mark repair apparatus 34, which is fabricated from ferrous-containing magnetic material. Sports related item 40 has undergone the preservation process to help preserve and protect its visual appearance and texture and is covered by a transparent substance for ornamental display.

Figure 6:
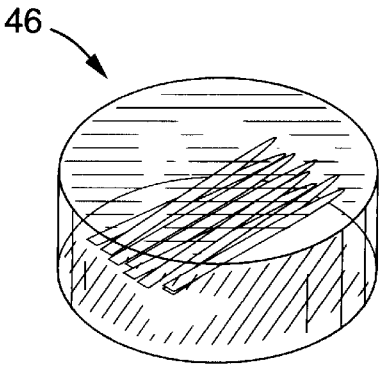
FIG. 6 is a perspective view of the ornament displaying a sports related item shown in FIG. 4A.
Figure 5:
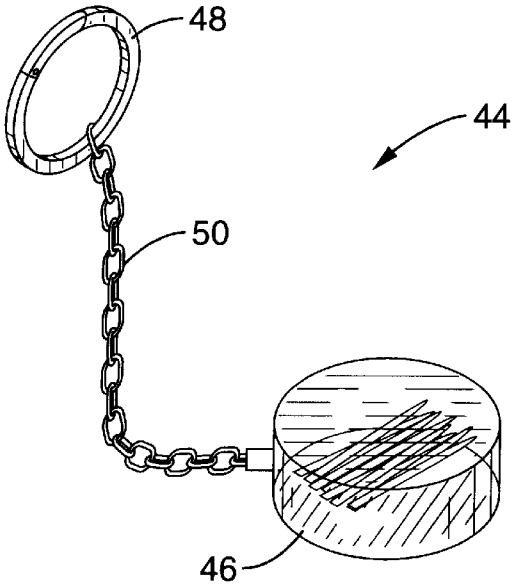
FIG. 5 is a perspective view of a key chain attached to an ornament displaying a sports related item which embodies the preservation method of the present invention.

In FIG. 5 and FIG. 6, a key chain apparatus 44 and a sports related item 46, respectively, is generally shown. A key ring 48 is attached to sports related item 46 by a chain 50. Sports related item 46 has undergone the preservation process to help preserve and protect its visual appearance and texture and is covered by a transparent substance for ornamental display.

Figure 7:
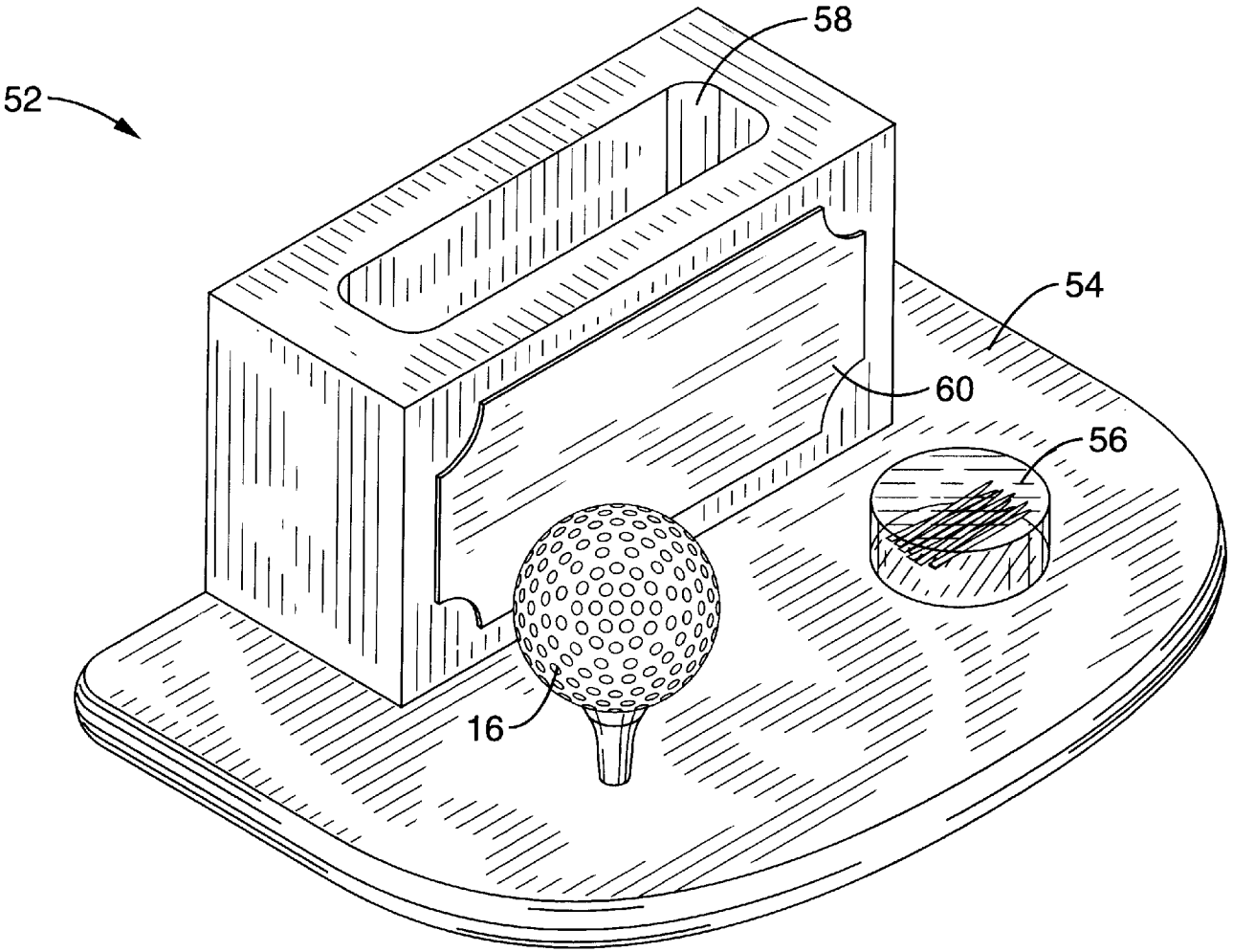
FIG. 7 is a perspective view of an ornamental desk set having a business card holder which displays a sports related item embodying the preservation method of the present invention.

In FIG. 7, a business card holder apparatus 52 is generally shown. Business card holder apparatus 52 incorporates a base 54. Disposed on base 54 are logo sports ball 16, a sports related item 56 and a business card holder 58. An authenticity plaque 60 is displayed on business card holder 58. Sports related item 56 has undergone the preservation process to help preserve and protect its visual appearance and texture and is covered by a transparent substance for ornamental display.

Figure 8:
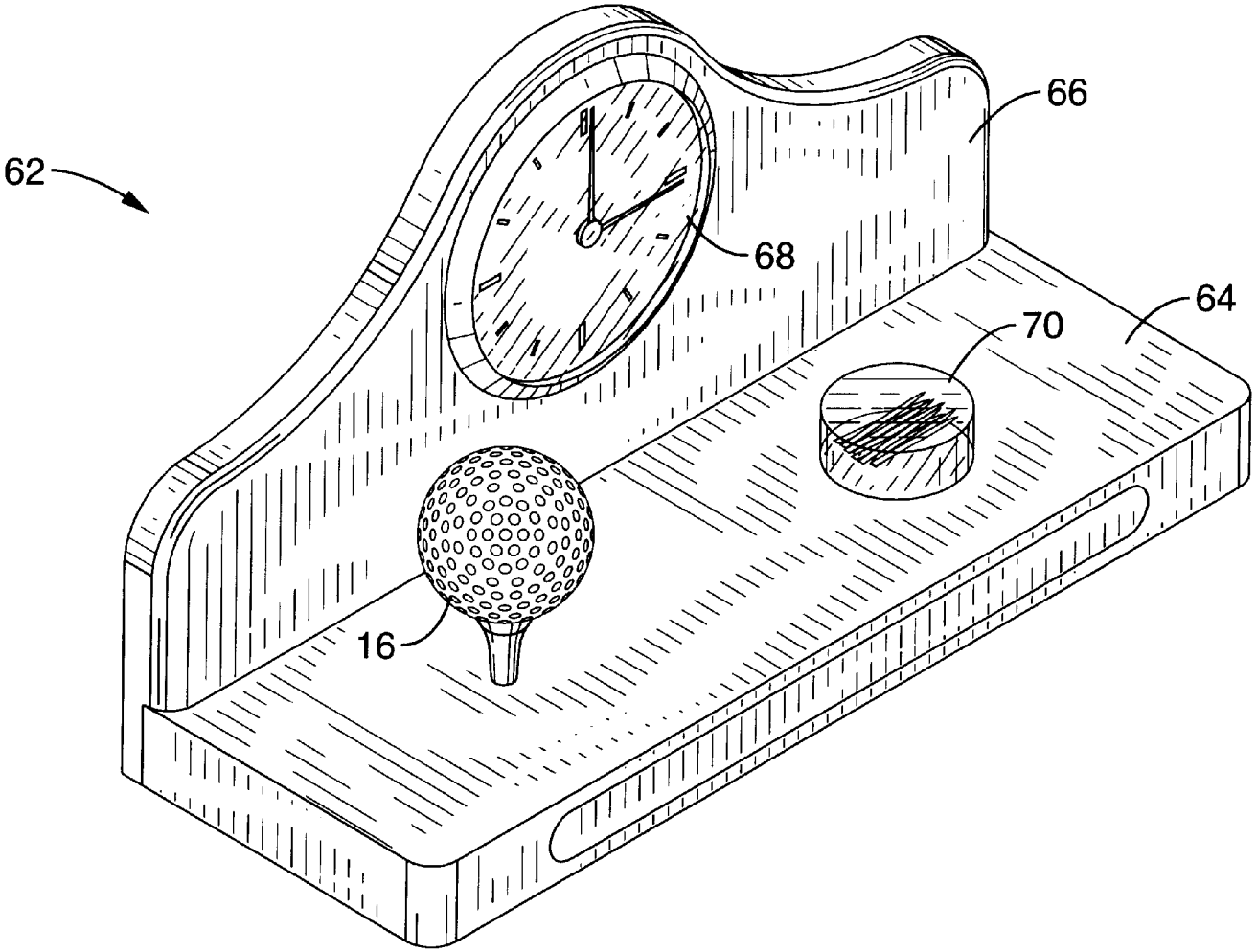
FIG. 8 is a perspective view of an ornamental desk clock which displays a sports related item embodying the preservation method of the present invention.

In FIG. 8, a desk clock apparatus 62 is generally shown. Desk clock apparatus 62 includes a base 64 and a wall 66. A clock 68 is mounted within wall 66. Logo sports ball 16 and sports related item 70 are disposed on base 64. Sports related item 62 has undergone the preservation process to help preserve and protect its visual appearance and texture and is covered by a transparent substance for ornamental display.

Figure 9:
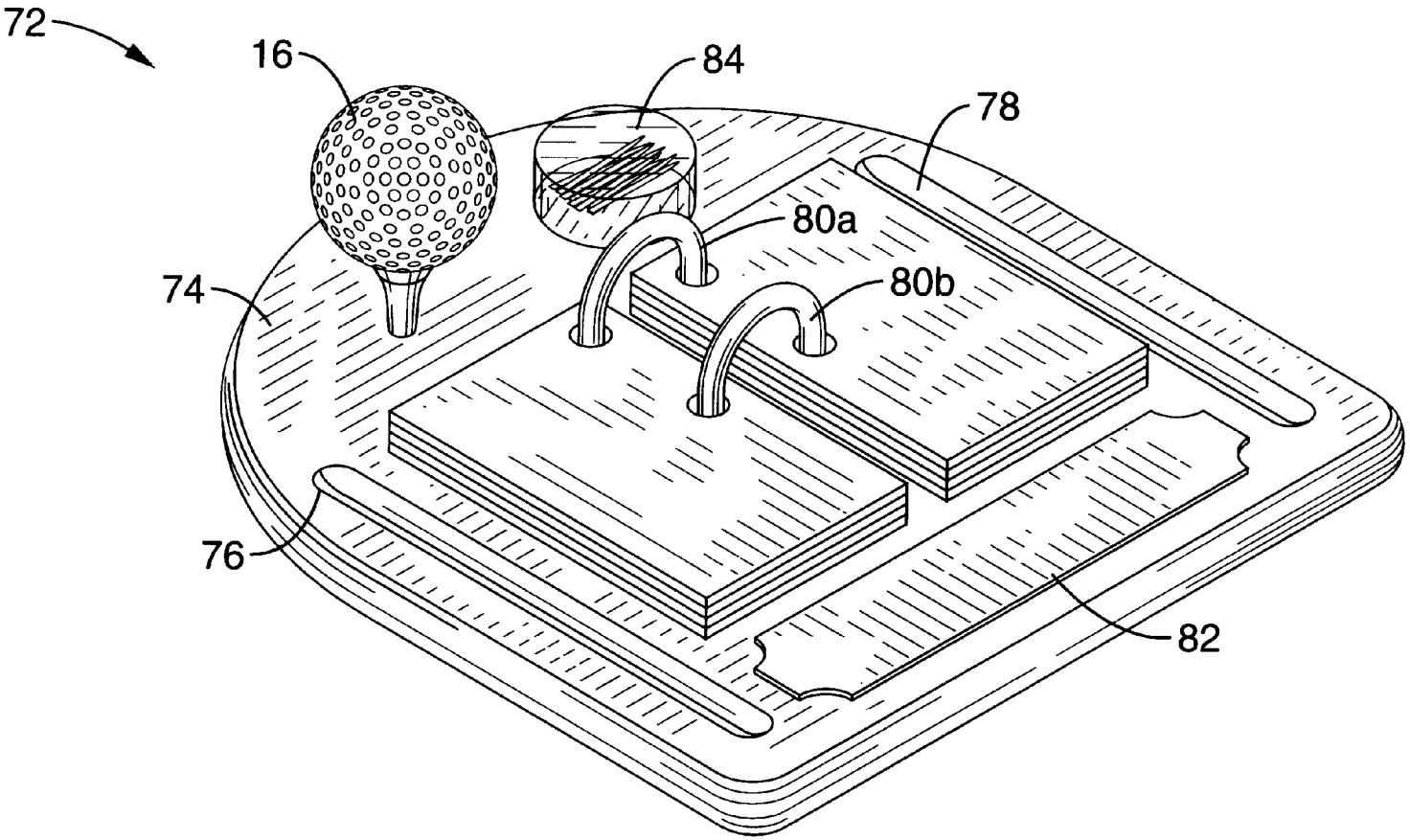
FIG. 9 is a perspective view of an ornamental desk set calendar which displays a sports related item embodying the preservation method of the present invention.

In FIG. 9, a desk calendar apparatus 72 is generally shown. Desk calendar apparatus 72 incorporates a base 74. Disposed on base 74 are a pen holder 76, a pencil holder 78, a calendar holder 80*a*, 80*b*, a certificate of authenticity 82, logo sports ball 16 and sports related item 84. Sports related item 84 has undergone the preservation process to help preserve and protect its visual appearance and texture and is covered by a transparent substance for ornamental display.

Figure 10:
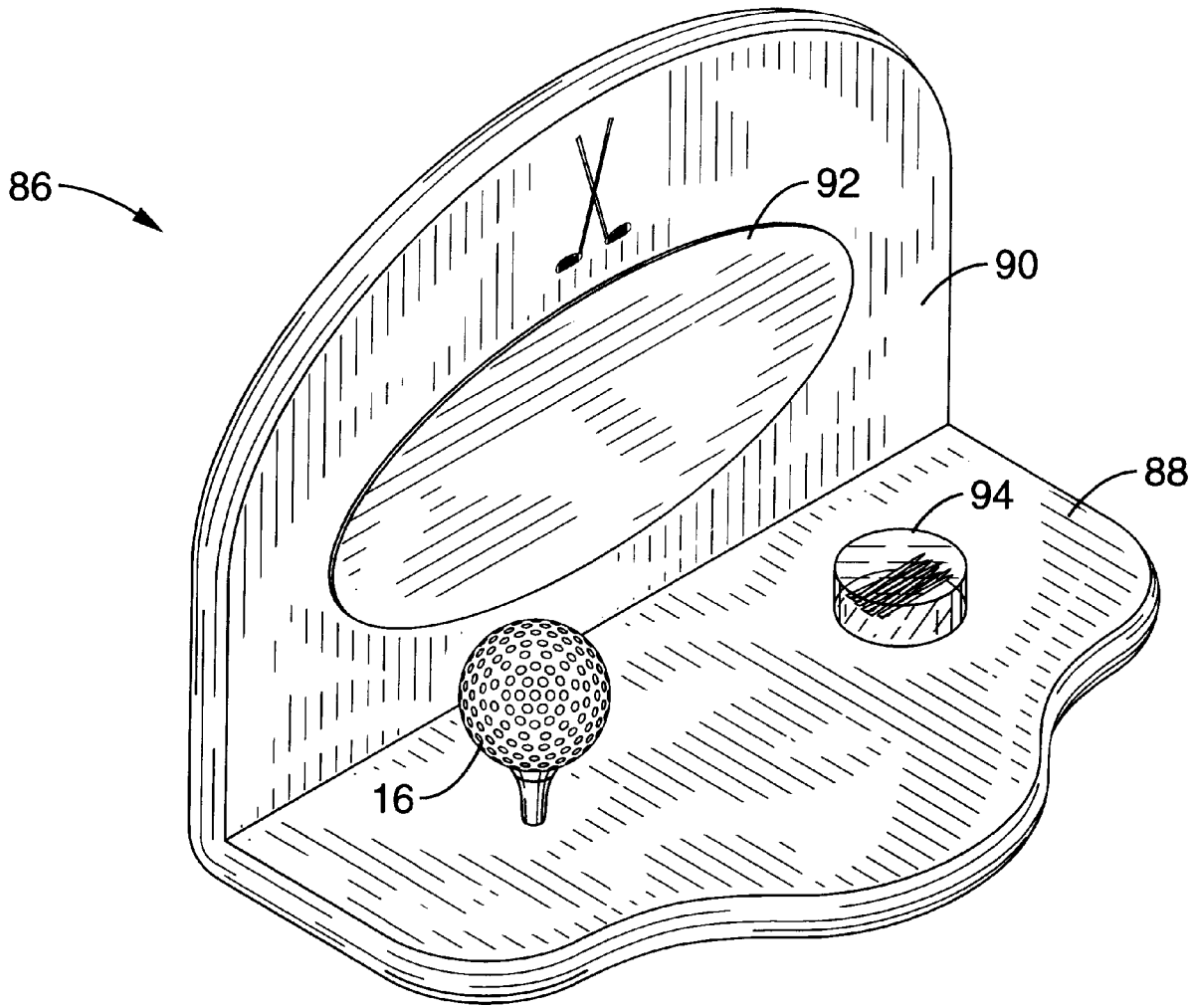
FIG. 10 is a perspective view of an ornamental desk set which displays a sports related item embodying the preservation method of the present invention.

In FIG. 10, an ornamental desk display apparatus 86 is generally shown. Ornamental desk display apparatus 86 includes a base 88 and a wall 90. A certificate of authenticity 92 is affixed onto wall 90. Logo sports ball 16 and sports related item 94 are disposed on base 88. Sports related item 94 has undergone the preservation process to help preserve and protect its visual appearance and texture and is covered by a transparent substance for ornamental display.

Figure 11:
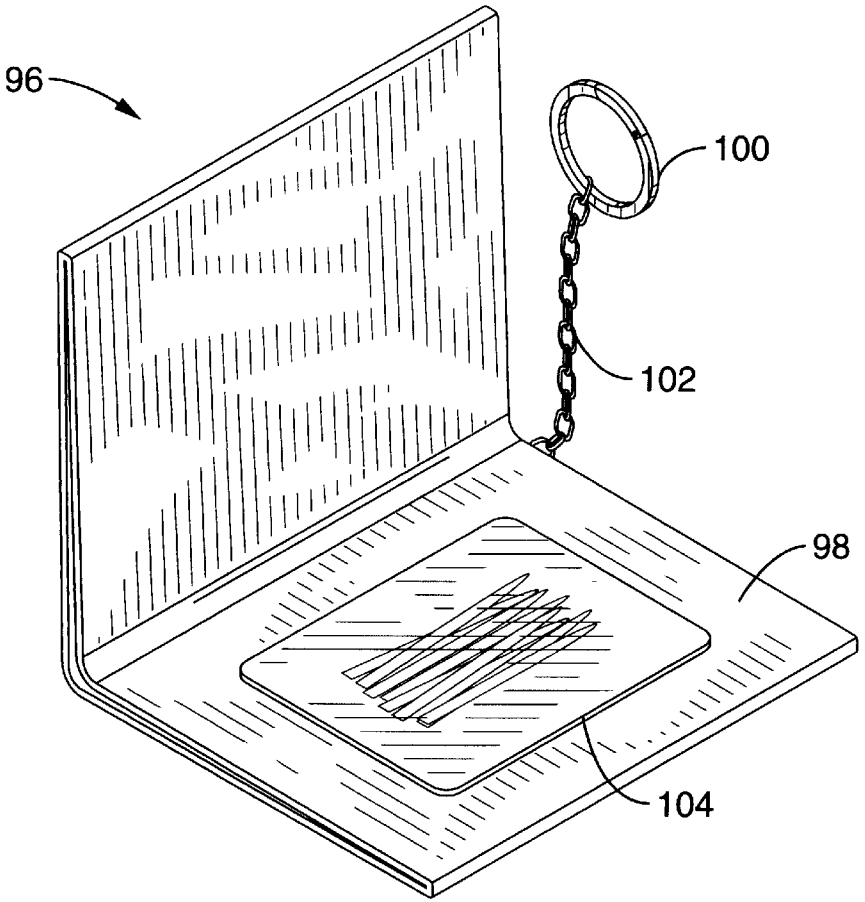
FIG. 11 is a perspective view of a key chain attached to billfold adapted to display a sports related item embodying the preservation method of the present invention.

In FIG. 11, a billfold apparatus 96 is generally shown. Billfold apparatus 96 includes a billfold 98, a key chain 100 and a chain 102 attaching key chain 100 to billfold 98. A sports related item 104 is also included in billfold 98 for ornamental display and has undergone the preservation process to help preserve and protect its visual appearance and texture and is covered by a transparent substance for ornamental display.

Figure 12:
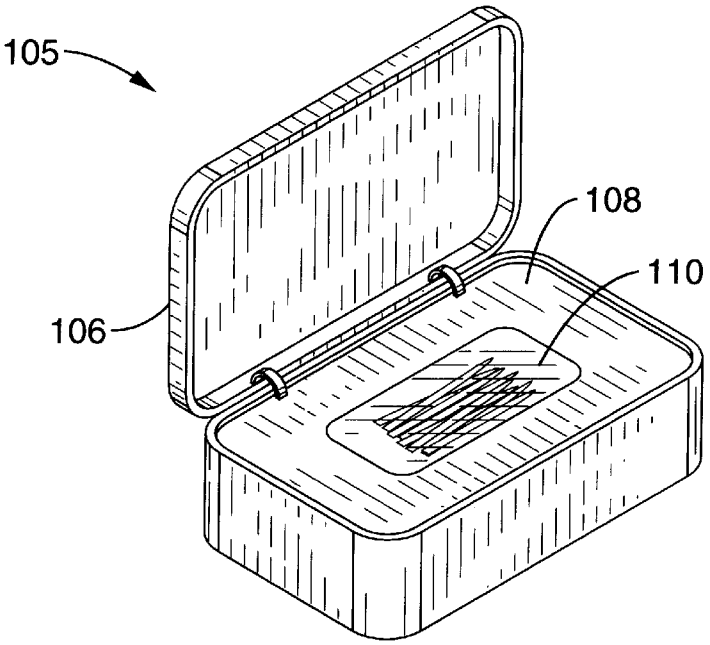
FIG. 12 is a perspective view of a hinged display case housing an ornament displaying a sports related item which embodies the preservation method of the present invention.

In FIG. 12, a hinged display case 105 is generally shown. Hinged display case 104 includes a cover 106 and a housing 108 adapted to mount a sports related item 110 therein. Sports related item 110 has undergone the preservation process to help preserve and protect its visual appearance and texture and is covered by a transparent substance for ornamental display.

Figure 13:
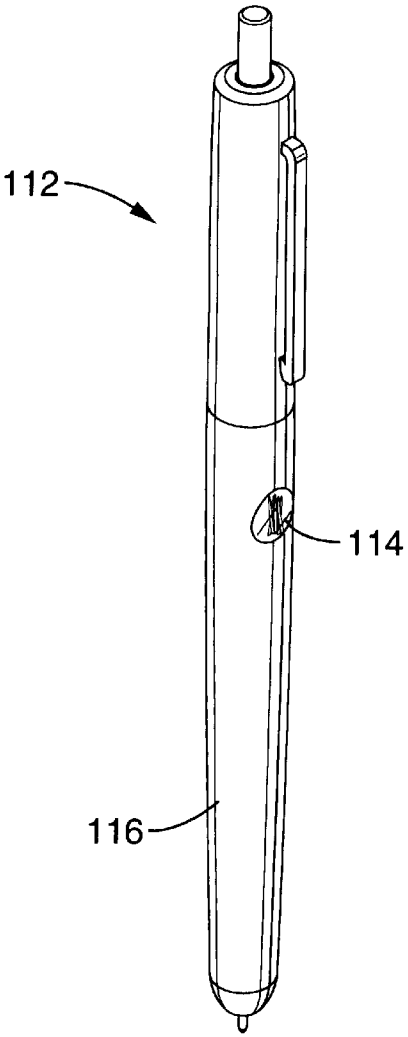
FIG. 13 is a perspective view of a pen which displays a sports related item embodying the preservation method of the present invention.

In FIG. 13, a pen 112 is shown whereupon a sports related item 114 is disposed onto the body 116 of pen 112. Sports related item 114 has undergone the preservation process to help preserve and protect its visual appearance and texture and is covered by a transparent substance for ornamental display.

Figure 14:
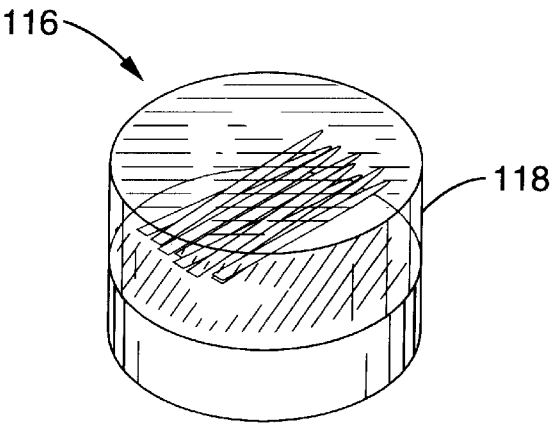
FIG. 14 is a perspective view of a paperweight which displays a sports related item embodying the preservation method of the present invention.

In FIG. 14, a paperweight 116 is shown whereupon a sports related item 118 is disposed onto the upper surface of paperweight 116. Sports related item 116 has undergone the preservation process to help preserve and protect its visual appearance and texture and is covered by a transparent substance for ornamental display.

The figures are representative samples of the various applications of the method and apparatus to preserve and display such sports related items disclosed in the present invention, and as such, are not to be construed as limitations. Those skilled in the art will appreciate that the method and apparatus to preserve and display such sports related items can also include a multitude of other sporting goods of interest, such as sports shoes; clocks; belt buckles; watches and/or watch bands; golf club bags; golf clubs and putters; paper weights; hats, clothing or other apparel; golf club head covers; stroke counters; golf club display racks; pro shop score card holders; apparel display racks; ball washers; license plate frames; sunglasses; lighters; and ash trays.

Accordingly, it will be seen that this invention provides for a method and apparatus for displaying sports related items which preserves the color, texture and visual effect of the item. Although the description above contains many specificities, these should not be construed as limiting the scope of the invention but as merely providing illustrations of some of the presently preferred embodiments of this invention.

What is claimed is:

1. A method for protecting and presenting sports-related memorabilia, comprising the steps of:

(a) preserving natural grass from an athletic playing field as an item of sports-related memorabilia associated with said athletic field;

(b) enclosing the preserved natural grass within a transparent container; and (c) mounting said container to a frame.

2. A method as recited in claim 1, further comprising the step of authenticating the item of sports-related memorabilia.

3. A method as recited in claim 1, wherein said natural grass comprises clippings from said athletic playing field.

4. A method as recited in claim 1, wherein said natural grass is attached to an aeration plug.

5. A method as recited in claim 1, wherein said athletic playing field comprises a golf course, football field or baseball field.

6. A method as recited in claim 1, further comprising the step of encapsulating said natural grass in said container.

7. A method as recited in claim 1, wherein the step of preserving said natural grass comprises freeze-drying said natural grass.

8. A method for protecting and presenting sports-related memorabilia, comprising the steps of:

(a) preserving natural grass from an athletic playing field as an item of sports-related memorabilia associated with said athletic field; and (b) enclosing the preserved natural grass within a transparent container;

(c) wherein said step of preserving said natural grass comprises freeze-drying said natural grass.

9. A method as recited in claim 8, further comprising the step of authenticating the item of sports-related memorabilia.

10. A method as recited in claim 8, wherein said natural grass comprises clippings from said athletic playing field.

11. A method as recited in claim 8, wherein said natural grass is attached to an aeration plug.

12. A method as recited in claim 8, wherein said athletic playing field comprises a golf course, football field or baseball field.

13. A method as recited in claim 8, further comprising the step of encapsulating said natural grass in said container.

14. A method as recited in claim 8, further comprising the step of mounting said container to a frame.

15. A method as recited in claim 8, further comprising the step of mounting said container to a base member.

16. A method as recited in claim 15, wherein the base member comprises a memorabilia display.

17. A method as recited in claim 16, wherein said base member comprises a plaque, desk accessory, or enclosure.

18. A method as recited in claim 15, wherein the base member comprises a small adornment or tool.

19. A method as recited in claim 18, wherein said base member comprises a key-chain, pen, or divot tool.

20. A method for protecting and presenting sports-related memorabilia, comprising the steps of:

(a) preserving natural grass from an athletic playing field as an item of sports-related memorabilia associated with said athletic field;

(b) enclosing the preserved natural grass within a transparent container; and (c) mounting the container to a base member.

21. A method as recited in claim 20, wherein the step of preserving said natural grass comprises freeze-drying said natural grass.

22. A method as recited in claim 20, further comprising the step of authenticating the item of sports-related memorabilia.

23. A method as recited in claim 20, wherein said natural grass comprises clippings from said athletic playing field.

24. A method as recited in claim 20, wherein said natural grass is attached to an aeration plug.

25. A method as recited in claim 20, wherein said athletic playing field comprises a golf course, football field or baseball field.

26. A method as recited in claim 20, further comprising the step of encapsulating said natural grass in said container.

27. A method as recited in claim 20, wherein the base member comprises a memorabilia display.

28. A method as recited in claim 20, wherein said base member comprises a plaque, desk accessory, or enclosure.

29. A method as recited in claim 20, wherein said base member comprises a key-chain, pen, or divot tool.

30. An apparatus for protecting and presenting sports related memorabilia, comprising:

(a) a transparent container;

(b) preserved natural grass from an athletic playing field retained within said container; and (c) a frame on which said container is mounted;

(d) wherein said natural grass is preserved as sports-related memorabilia associated with said athletic field.

31. An apparatus as recited in claim 30, wherein said natural grass has been preserved by a freeze-drying process.

32. An apparatus as recited in claim 30, wherein said natural grass comprises clippings from said athletic playing field.

33. An apparatus as recited in claim 30, wherein said natural grass is attached to an aeration plug.

34. An apparatus as recited in claim 30, wherein said athletic playing field comprises a golf course, football field or baseball field.

35. An apparatus as recited in claim 30, wherein said natural grass is encapsulated in said container.

36. An apparatus for protecting and presenting sports related memorabilia, comprising:

(a) a transparent container;

(b) preserved natural grass from an athletic playing field retained within said container; and (c) a base member on which said container is mounted;

(d) wherein said natural grass is preserved as sports-related memorabilia associated with said athletic field.

37. An apparatus as recited in claim 36, wherein said natural grass has been preserved by a freeze-drying process.

38. An apparatus as recited in claim 36, wherein said natural grass comprises clippings from said athletic playing field.

39. An apparatus as recited in claim 36, wherein said natural grass is attached to an aeration plug.

40. An apparatus as recited in claim 36, wherein said athletic playing field comprises a golf course, football field or baseball field.

41. An apparatus as recited in claim 36, wherein said natural grass is encapsulated in said container.

42. An apparatus as recited in claim 36, wherein the base member comprises a memorabilia display.

43. An apparatus as recited in claim 36, wherein said base member comprises a plaque, desk accessory, or enclosure.

44. An apparatus as recited in claim 36, wherein the base member comprises a small adornment or tool.

45. An apparatus as recited in claim 36, wherein said base member comprises a key-chain, pen, or divot tool.

46. An apparatus for protecting and presenting sports related memorabilia, comprising:

(a) a transparent container; and (b) preserved natural grass from an athletic playing field retained within said container;

(c) wherein said natural grass is preserved as sports-related memorabilia associated with said athletic field; and (d) wherein said natural grass has been preserved by a freeze-drying process.

47. An apparatus as recited in claim 46, wherein said natural grass comprises clippings from said athletic playing field.

48. An apparatus as recited in claim 46, wherein said natural grass is attached to an aeration plug.

49. An apparatus as recited in claim 46, wherein said athletic playing field comprises a golf course, football field or baseball field.

50. An apparatus as recited in claim 46, wherein said natural grass is encapsulated in said container.

51. An apparatus as recited in claim 46, wherein the base member comprises a memorabilia display.

52. An apparatus as recited in claim 46, wherein said base member comprises a plaque, desk accessory, or enclosure.

53. An apparatus as recited in claim 46, wherein the base member comprises a small adornment or tool.

54. An apparatus as recited in claim 46, wherein said base member comprises a key-chain, pen, or divot tool.

55. A method for protecting and presenting sports-related memorabilia, comprising the steps of:

(a) freeze-drying natural grass from an athletic playing field, wherein the freeze-dried grass retains its color and appearance;

(b) encapsulating the freeze-dried grass within an enclosure configured with transparent portions thereof for the viewing of said grass; and (c) authenticating said grass as being associated with said athletic playing field;

(d) wherein said grass is preserved as sports-related memorabilia associated with said athletic field.

56. A method as recited in claim 55, further comprising the step of attaching the encapsulated freeze-dried grass to a base member which is further capable of displaying additional elements of associated memorabilia.

* * * * *